US005743189A

United States Patent [19]

Compera et al.

[11] Patent Number: 5,743,189

[45] Date of Patent: Apr. 28, 1998

[54] METHOD FOR SUPPLYING INK TO A PRINTING PRESS

[75] Inventors: Christian Compera, Dossenheim; Martin Greive, Heidelberg; Bernd Herrmann, Malsch; Anton Rodi, Leimen, all of Germany

[73] Assignee: Heidelberger Druckmaschinen AG, Heidelberg, Germany

[21] Appl. No.: 679,982

[22] Filed: Jul. 15, 1996

[30] Foreign Application Priority Data

Jul. 15, 1995 [DE] Germany ..... 195 25 848.7

[51] Int. Cl.[6] ..... B41J 2/175

[52] U.S. Cl. ..... 101/487; 347/88

[58] Field of Search ..... 101/487; 347/88, 347/103

[56] References Cited

U.S. PATENT DOCUMENTS

| | | | |
|---|---|---|---|
| 4,550,324 | 10/1985 | Tamaru et al. | 347/88 |
| 5,211,690 | 5/1993 | Mizoguchi et al. | 271/10 |
| 5,235,350 | 8/1993 | Lin et al. | 347/88 |
| 5,471,233 | 11/1995 | Okamoto et al. | 347/103 |

FOREIGN PATENT DOCUMENTS

| | | | |
|---|---|---|---|
| 0 163 808 | 9/1989 | European Pat. Off. . | |
| 42 05 636 | 8/1993 | Germany . | |
| 42 05 682 | 8/1993 | Germany . | |
| 358140257 | 8/1983 | Japan | 347/88 |
| 362290545 | 12/1987 | Japan | 347/88 |
| 506 338 | 6/1971 | Switzerland . | |
| 227 771 | 1/1925 | United Kingdom . | |

*Primary Examiner*—Edgar S. Burr
*Assistant Examiner*—Amanda B. Sandusky
*Attorney, Agent, or Firm*—Herbert L. Lerner; Laurence A. Greenberg

[57] ABSTRACT

Method for supplying a printing unit of a printing press with ink which is solid at normal temperature includes supplying the printing unit with ink in the form of solid bodies, and melting the solid ink bodies in the printing unit and applying the ink in a molten state to a cylinder of the printing unit.

2 Claims, 1 Drawing Sheet

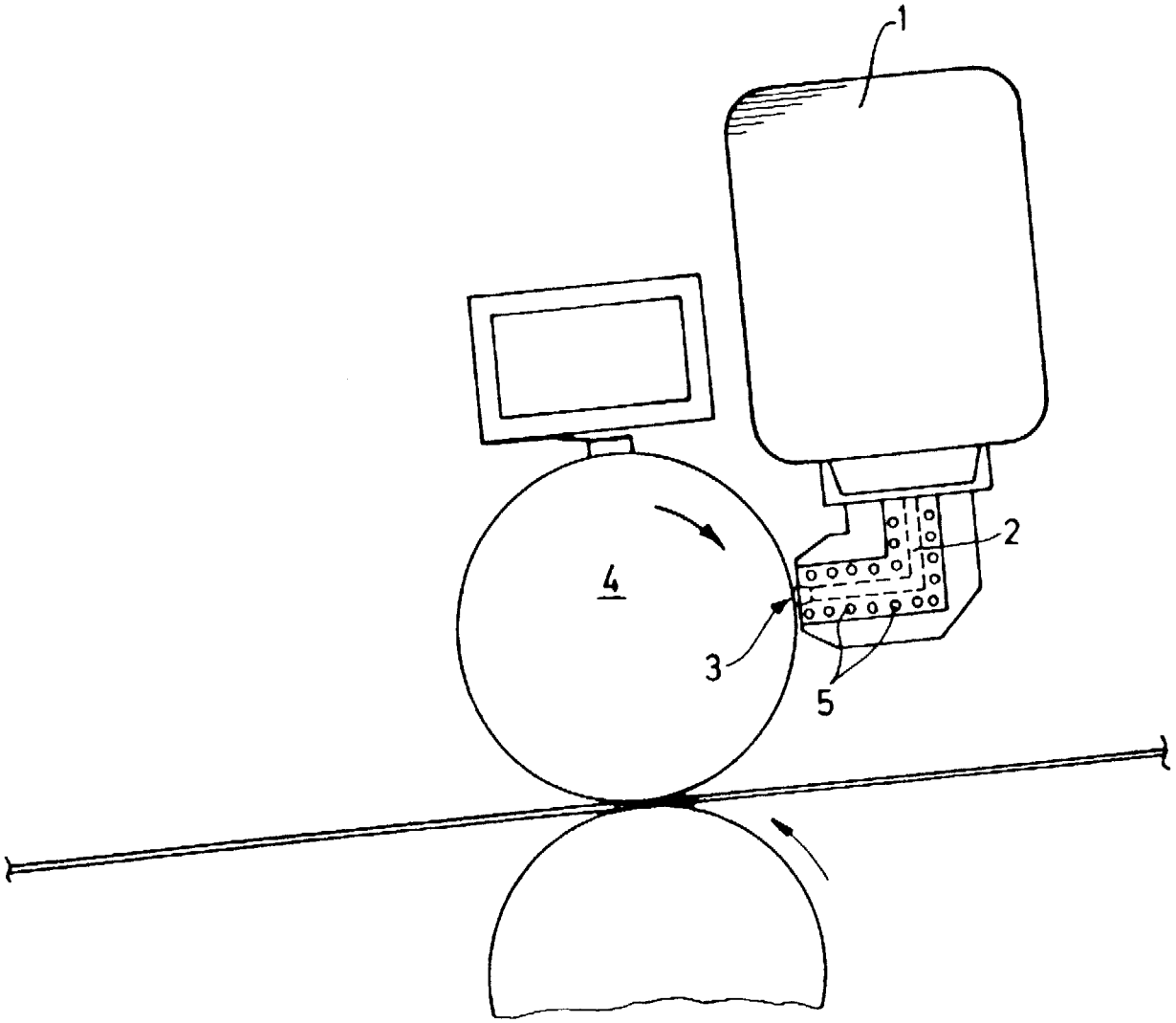
1
2
3
4
5

METHOD FOR SUPPLYING INK TO A PRINTING PRESS

BACKGROUND OF THE INVENTION

FIELD OF THE INVENTION

The invention relates to a method and a device for supplying ink to a printing press and, more particularly, for supplying a printing unit of a printing press with an ink which is solid at normal temperature.

An example of a printing ink which is solid at normal temperature is toner powder which is used in laser printers. The toner powder, which is fine-grained, is transferred to printing paper in a distribution corresponding to or matching the structure to be printed, and is then fixed thereon by melting.

If an ink which is solid at normal temperature is to be used in a printing press having printing units arranged for transferring the ink to printing paper in liquid form, a problem arises of having to keep the ink warm over the entire paper transport path.

SUMMARY OF THE INVENTION

It is accordingly an object of the invention to provide a method and a device for supplying ink to a printing press and, more particularly, ink which is solid at normal temperature, in a relatively simpler and more economical manner than heretofore known methods and devices of the foregoing general type.

With the foregoing and other objects in view, there is provided, in accordance with the invention, a method for supplying a printing unit of a printing press with ink which is solid at normal temperature, which comprises supplying the printing unit with ink in the form of solid bodies, and melting the solid ink bodies in the printing unit and applying the ink in a molten state to a cylinder of the printing unit.

In accordance with another mode, the method of the invention includes transporting the solid bodies to the vicinity of a transfer location at which the ink is to be transferred to the cylinder, and performing the melting thereat.

In accordance with a further mode, the method of the invention includes supplying the solid bodies to a container communicating via at least one channel with a transfer location at which the ink is to be applied to the cylinder.

In accordance with an added mode, the method of the invention includes heating at least one of the container and the at least one channel.

In accordance with an additional mode, the method of the invention includes feeding the ink through the channel by at least one of gravity and a conveying device.

In accordance with yet another mode, the method of the invention includes providing the solid bodies in granulate form, sheet form, wire form, bar form, plate form or rod form.

In accordance with another aspect of the invention, there is provided a device for supplying a printing unit of a printing press with ink which is solid at normal temperature, comprising a device for receiving the ink in the form of solid bodies, and a heater for melting the solid bodies at a location preceding a transfer location at which the ink is transferred to a cylinder of the printing unit.

In accordance with another feature of the invention, the ink-receiving device is a container, and at least one channel is included via which the container communicates with the transfer location.

In accordance with a further feature of the device of the invention, at least one of the container and the at least one channel is provided with the heater.

In accordance with an added feature of the device of the invention, at least one of the container and the at least one channel is disposed so that the ink is fed by gravity through the channel.

In accordance with an additional feature of the device of the invention, at least one of the container and at least one channel has an ink-conveying device.

In accordance with a concomitant feature of the device of the invention, the ink-receiving device is arranged for receiving ink in the form of granulate, sheets, wires, bars, plates or rods.

In accordance with the invention, the solid bodies, which may for example be in the form of granulate, sheets or foils, wires or even bars, plates or slabs, or rods, can be transported and handled more simply than liquids and need not be kept warm during transport to the printing press.

Individually manipulatable solid bodies, such as bars, can be transported to the vicinity of a transfer location or point, which is a somewhat linear region on the circumference of a cylinder onto which the ink is to be transferred. Not until the solid body or bodies of ink are near the transfer location or point is the ink heated and melted, and then received in the molten state by the cylinder surface. A very good metering capability is attained through the use of wire-shaped ink, which is brought to the heating point in the solid state and is distributed over the printing width or breadth in liquid form. Similar results are attained with ink in sheet or foil form, which is supplied for uniform distribution over the entire printing width or breadth.

In an embodiment wherein the shape of the solid bodies is not important and which is accordingly especially well-suited for processing granular or pulverulent ink, the solid bodies are fed into a container, which communicates via at least one channel or conduit with the transfer location or point. The heater may be provided in the container, so that the ink melted therein then flows by gravity through the channel or conduit; alternatively, the heater may be disposed only in the channel or conduit, into which an ink in granular form slides and is then gradually melted. The container and the channel or conduit may, however, also both be heatable, and ink replenishment can be reinforced by a suitable conveying device.

Other features which are considered as characteristic for the invention are set forth in the appended claims.

Although the invention is illustrated and described herein as embodied in a method and a device for supplying ink to a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWING

The single unnumbered figure is a diagrammatic side elevational view of a printing unit being supplied with an ink which is solid at normal temperature.

DESCRIPTION OF THE PREFERRED EMBODIMENTS

Referring now to the single figure of the drawing, there is shown therein a container 1 of suitable capacity for retaining a supply of solid ink, for example, in pulverulent form, for a printing unit. The container 1 communicates at the underside thereof with a channel 2, which discharges the ink at a transfer location or point 3 at the surface of a cylinder 4 of the printing unit.

The cylinder 4 rotates in the direction of the curved arrow associated therewith in the drawing, and may be a printing cylinder, which transfers the ink directly onto the printing paper, as shown. Alternatively, the cylinder 4 may be an inking roller which precedes a printing cylinder.

The container 1 includes a non-illustrated heater. Heating coils 5 are also placed around the channel 2. The cylinder 4 may be heatable likewise.

As noted hereinbefore, the ink which is used is solid at normal or approximate room temperature (20° C.) and, in this exemplary embodiment, is supplied in granulate form. The granulate is fed into the container 1 and heated by the heater to approximately 150° C. At this temperature, the ink is liquid and flows through the channel 2 to the transfer point 3, the ink being kept liquid by the heating coils 5.

In order to distribute the ink uniformly over the surface of the cylinder 4, the channel 2 may extend perpendicularly to the plane of the drawing over the entire width of the printing press, or else a plurality of channels or conduits 2 are provided which are distributed over the width or breadth of the press; the terminating or discharge region thereof being again linear in shape, if desired.

If the channel 2 is constructed with a relatively larger diameter than that shown in the drawing, it is possible to dispense with a heater in the container 1, as long as the heating coils 5 gradually liquefy the downwardly trickling granulate. To reinforce ink replenishment, non-illustrated feeding means, such as screw or worm conveyors, may be provided.

In another exemplary embodiment, otherwise not shown in detail, instead of the container 1, a spool or coil is provided, whereon the ink supply is provided in the form of wound or coiled wire. The wire is brought to the vicinity of the transfer point 3, remaining unmelted until then, and is steadily resupplied. The distribution over the printing width or breadth occurs in liquid form.

In yet another non-illustrated exemplary embodiment, the ink supply is in the form of a coiled foil or sheet having a free end which is brought to a heating location and melted thereat. The foil or sheet extends over the entire printing width or breadth, thereby assuring a uniform distribution, and ink replenishment is effected simply by further transporting the sheet so that, just as in the exemplary embodiment wherein the ink supply is in the form of a wire, the ink supply is meterable very precisely.

If the demands for meterability are less stringent, the ink supply can also be in the form of solid bodies such as bars, plates or rods, which are firmly held in the vicinity of the transfer location and gradually transported to the heating location.

We claim:

1. Method for supplying a printing unit of a printing press with ink which is solid at normal temperature, which comprises:

supplying a printing unit with ink in the form of solid bodies selected from the group consisting of sheet forms and slab forms, melting the solid bodies in the printing unit, transporting the solid bodies through at least one L-shaped channel to a vicinity of a transfer location at which the ink is to be transferred to a cylinder, and performing additional heating in the at least one L-shaped channel, and applying the ink in a molten state to the cylinder of the printing unit.

2. Method for supplying a printing unit of a printing press with ink which is solid at normal temperature, which comprises:

supplying a printing unit having a container with ink in the form of solid bodies selected from the group consisting of sheet forms and slab forms, supplying the solid bodies to the container, the container communicating via at least one channel with a transfer location at which the ink is to be applied to a cylinder and feeding the ink through the at least one channel by a conveying device, melting the solid bodies in the container, and applying the ink in a molten state to the cylinder of the printing unit.

* * * * *